US007793760B2

(12) United States Patent
Ito et al.

(10) Patent No.: US 7,793,760 B2
(45) Date of Patent: Sep. 14, 2010

(54) ELEVATOR

(75) Inventors: Hiroaki Ito, Tokyo (JP); Mimpei Morishita, Tokyo (JP)

(73) Assignee: Toshiba Elevator Kabushiki Kaisha, Tokyo (JP)

( * ) Notice: Subject to any disclaimer, the term of this patent is extended or adjusted under 35 U.S.C. 154(b) by 499 days.

(21) Appl. No.: 11/813,310

(22) PCT Filed: Dec. 28, 2005

(86) PCT No.: PCT/JP2005/024030

§ 371 (c)(1),
(2), (4) Date: Aug. 7, 2007

(87) PCT Pub. No.: WO2006/073105

PCT Pub. Date: Jul. 13, 2006

(65) Prior Publication Data

US 2008/0110701 A1 May 15, 2008

(30) Foreign Application Priority Data

Jan. 5, 2005 (JP) ..... 2005-000563

(51) Int. Cl.
*B66B 7/04* (2006.01)
*B66B 1/34* (2006.01)

(52) U.S. Cl. ..... 187/292; 187/393; 187/409; 361/143

(58) Field of Classification Search ..... 187/292, 187/391–394, 409; 361/143, 144, 146, 152, 361/154

See application file for complete search history.

(56) References Cited

U.S. PATENT DOCUMENTS

| | | | | |
|---|---|---|---|---|
| 4,838,172 | A * | 6/1989 | Morishita et al. | 104/281 |
| 4,924,778 | A * | 5/1990 | Morishita et al. | 104/284 |
| 5,027,925 | A * | 7/1991 | Kahkipuro | 187/292 |
| 5,379,864 | A * | 1/1995 | Colby | 187/393 |
| 5,439,075 | A | 8/1995 | Skalski et al. | |
| 5,715,914 | A | 2/1998 | Traktovenko | |
| 5,749,444 | A * | 5/1998 | Skalski | 187/409 |
| 5,866,861 | A * | 2/1999 | Rajamani et al. | 187/292 |
| 6,338,396 | B1 * | 1/2002 | Morishita | 187/292 |
| 6,408,987 | B2 * | 6/2002 | Morishita | 187/292 |

(Continued)

FOREIGN PATENT DOCUMENTS

CN 1279207 A 1/2001

(Continued)

*Primary Examiner*—Walter Benson
*Assistant Examiner*—Eduardo Colon
(74) *Attorney, Agent, or Firm*—Foley & Lardner LLP

(57) ABSTRACT

An elevator includes guide rails laid in an elevator shaft vertically, an elevator car moving up and down along the guide rails, guiding units provided on the elevator car for guiding it, the guiding unit having a magnet unit including cores and coils forming electromagnets to generate a magnetic force against the guide rail through an air gap and a controller for controlling the magnetic force by maneuvering an exciting current for exciting the electromagnets. The controller controls the magnetic force so as to make the guiding units in non-contact with the guide rails when the elevator car is traveling and brings the guiding units into contact with the guide rails when the elevator car is stopped, so that the guiding units attract and fix the guide rails while the elevator car is stopped.

12 Claims, 12 Drawing Sheets

U.S. PATENT DOCUMENTS

| | | | | |
|---|---|---|---|---|
| 6,786,304 | B2 * | 9/2004 | Utsunomiya et al. | 187/292 |
| 7,314,119 | B2 * | 1/2008 | Husmann et al. | 187/292 |
| 7,543,686 | B2 * | 6/2009 | Kulak et al. | 187/292 |

FOREIGN PATENT DOCUMENTS

| | | | |
|---|---|---|---|
| EP | 1 067 083 | A2 | 1/2001 |
| JP | 5-178563 | A | 7/1993 |
| JP | 6-336383 | A | 12/1994 |
| JP | 7-196273 | A | 8/1995 |
| JP | 2001-19286 | A | 1/2001 |
| JP | 2004-140763 | A | 5/2004 |
| JP | 2005-333772 | A | 12/2005 |

* cited by examiner

ELEVATOR

TECHNICAL FIELD

The present invention relates to an improvement of an elevator that is adapted so as to guide an elevator car in non-contact with guide rails.

BACKGROUND OF ART

In an elevator, generally, an elevator car suspended by a rope moves up and down along a pair of guide rails laid in an elevator shaft vertically. Although the elevator car swings due to disequilibrium of loads or movements of passengers, these swing movements are suppressed since the elevator's traveling is guided by the guide rails.

As for guiding units for an elevator car, either roller guides having wheels rolling on the guide rail and suspensions or guide shoes sliding on the guide rail have been adopted in the past. In a contact-type guide like this, however, there is a case that the amenity of an elevator is damaged since vibration and noise originating in a distortion of the guide and its joints are transmitted to the interior of the elevator car through the guiding units, or due to rolling noise originating in the roller guide in rotation sound.

In order to solve such a problem, there is proposed a method of guiding the elevator car in non-contact with the guide rails, as shown in the following Patent Document No. 1. Here, guiding units having electromagnets are mounted on the elevator car to apply magnetic force on the guide rails made of iron.

In this method, each magnetic force between the guide rail and the guiding unit is controlled by exciting the electromagnets arranged on four corners of the elevator car and each surrounding the guide rail in three directions, allowing the guide rail to guide the elevator car in non-contact manner.

In the following Patent Document No. 2, there is further proposed a structure where the guiding unit is provided with a permanent magnet as means for solving both reduction in controllability and increase in electric power consumption, both of which are present problems for the guiding unit for an elevator in accordance with the above-mentioned method.

Thus, with use of the permanent magnets in combination with the electromagnet, it is possible to offer an elevator capable of guiding an elevator car with soft-suspention and long stroke while consuming lower amounts of power.

Patent Document No. 1: Japanese Patent Application Laid-open (Heisei) No. 5-178563

Patent Document No. 2: Japanese Patent Application Laid-open No. 2001-19286

DISCLOSURE OF THE INVENTION

In this elevator equipped with the conventional guiding unit using magnetic force, the elevator car is kept in non-contact with the guide rails while the elevator car is stopped, for example, in a situation of no passenger's call for the elevator car or situation during the passengers are getting in and out the elevator through an opened elevator door.

Generally, if the supporting rigidities of the guiding units during the elevator car is traveling are reduced so that the influences of irregularities and joints of the guide rails are transmitted to the elevator car with difficulty, then the elevator can provide passengers with comfortable ride quality. The same logic applies on an elevator having guiding units adopting magnetic force and therefore, if supporting the elevator car with low rigidity during it is traveling, then it is possible to improve the ride quality for passengers.

However, if supporting the elevator car with low rigidity even when it is stopped, there arises a problem that an application of a relatively-large load on the elevator car in the horizontal direction, which may be accompanied with the passengers' getting in and out the elevator, causes the elevator car to be swung or the guiding units to collide with the guide rails.

In this regard, Patent Document No. 1 proposes a technique of switching a supporting rigidity against the elevator car during the elevator car is stopped from when the elevator is traveling.

In this technique also, however, it is difficult to stop the swing motion of the elevator car in opposition to an excessive load that may be produced when the passengers get in and out the elevator. In the general electromagnetic guide control, additionally, it is necessary to establish high response sensitivity in association with enhanced supporting rigidity, causing a current value for exciting coils forming the electromagnet to be increased. In such a case, the electric power consumption is increased and additionally, there arise both problems of a reduced stability of a control system and a resonance of the elevator with a structural element.

In order to solve the above-mentioned problem, an object of the present invention is to provide an elevator capable of supporting an elevator car with high rigidity when the elevator car is stopped.

Another object to the present invention is to provide an elevator which is directed to prevention of both reduction in the stability of a control system and occurrence of resonance while consuming lower amounts of power in supporting the elevator car with high rigidity.

In order to attain the above-mentioned objects, an elevator in accordance with one aspect of the present invention comprises:

a guide rail provided in an elevator shaft vertically;

an elevator car moving up and down along the guide rail;

a guiding unit provided on the elevator car for guiding the elevator car, the guiding unit having a magnet unit containing a core and coils forming an electromagnet thereby generating a magnetic force against the guide rail through an air gap; and a controller for controlling the magnetic force by maneuvering an exciting current for exciting the electromagnet, wherein the controller controls the magnetic force so as to bring the guiding unit into non-contact with the guide rail when the elevator car is traveling and bring the guiding unit into contact with the guide rail when the elevator car is stopped, whereby the guiding unit attracts and fixes the guide rail while the elevator car is stopped.

According to the elevator in the above aspect of the present invention, there is no possibility that the elevator car swings or the guiding unit collides with the guide rail since passengers get in and out the elevator under condition that the elevator car is fixed on the guide rail when the elevator car is stopped.

BEST MODE FOR CARRYING OUT THE INVENTION

Figure 1:
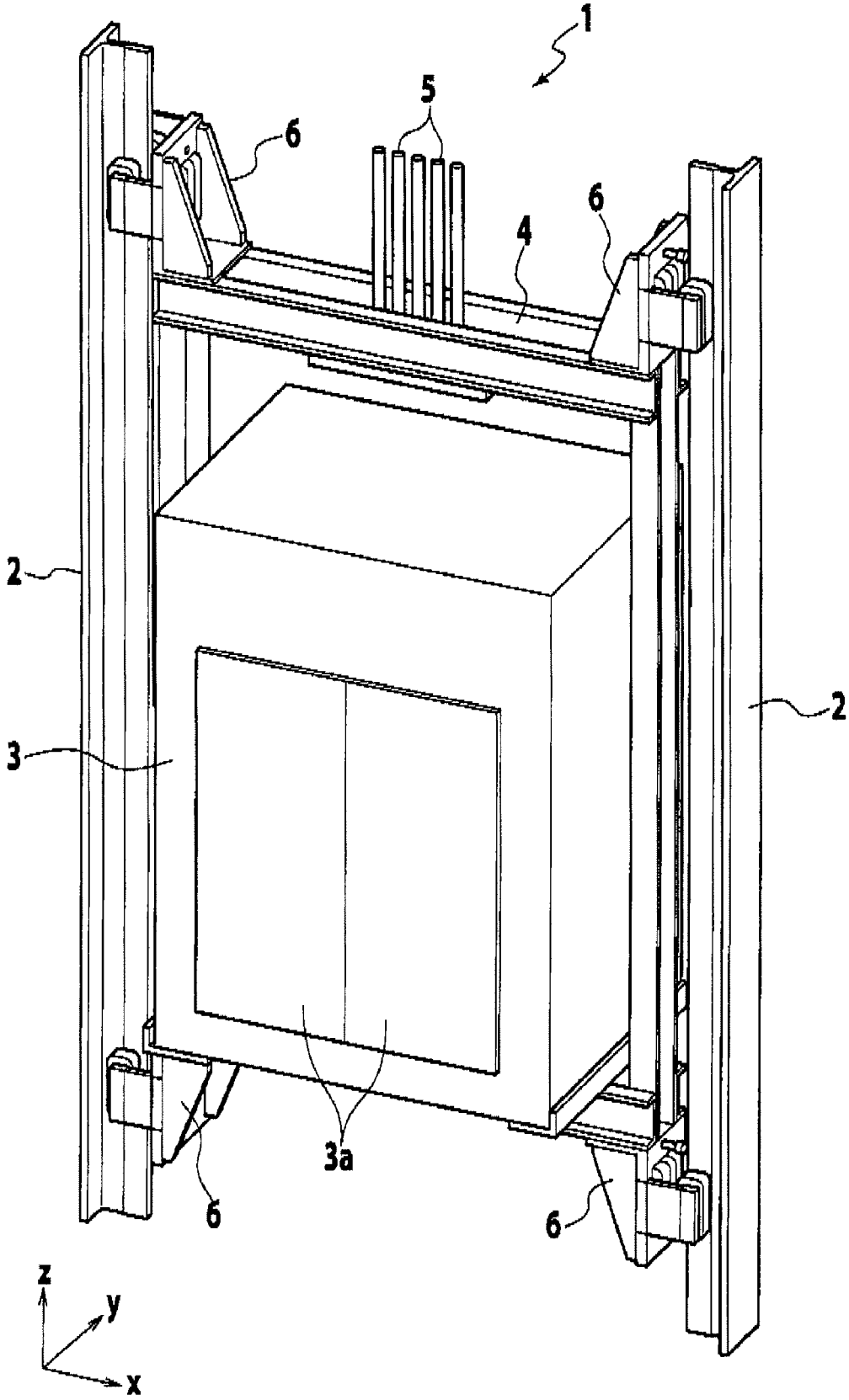
FIG. 1 is a perspective view showing an elevator in accordance with a first embodiment of the present invention.

FIG. 1 is a perspective view showing an elevator in accordance with the first embodiment of the present invention.

Inside an elevator shaft 1 in the same figure, there are vertically laid a pair of iron guide rails 2 made of ferromagnetic bodies and having a T-shaped cross section.

An elevator car 3 is fixed, on both sides thereof, to an inner side of a frame part 4 providing a rectangular framework. The elevator car 3 has a front door 3*a* arranged to oppose an elevator hall and is suspended in the elevator shaft 1 by ropes 5 which are connected to an upper part of the flame part 4 through respective one ends. With the arrangement, the elevator car 3 moves up and down in the elevator shaft 1 owing to driving means, for example, a rope lift-duty machine.

Guiding units 6 are fixed on four upper and lower corners of the frame part 4 so as to oppose the guide rails 2. Using these guiding units 6, the elevator car 3 is guided so as to be movable up and down along the guide rails 2.

Figure 2:
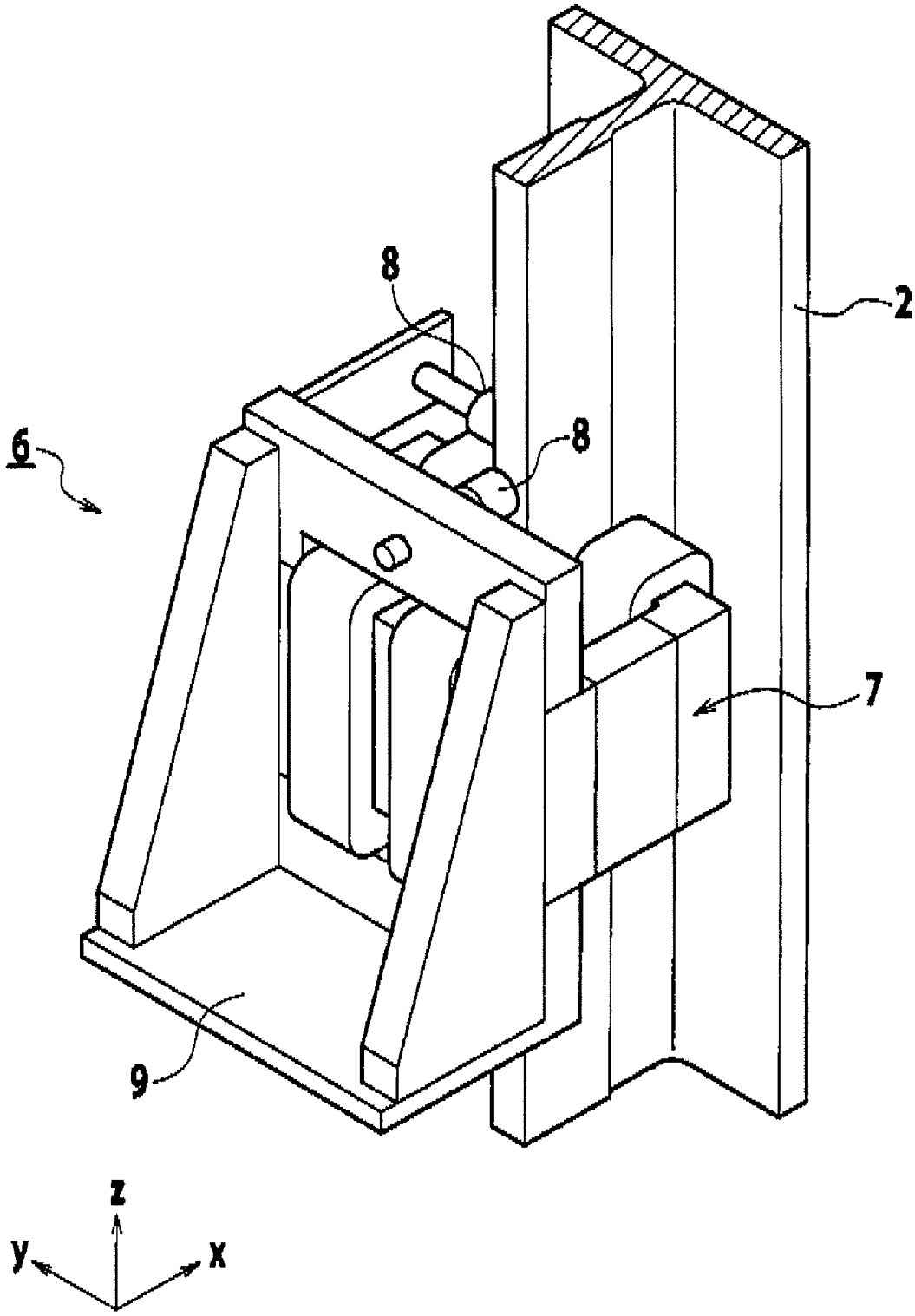
FIG. 2 is a perspective view showing a guiding unit of the elevator of the first embodiment.

As shown in FIG. 2, each of the guiding units 6 comprises a magnet unit 7, a pair of gap sensor 8 arranged lengthwise and crosswise for detecting distances in both directions of x-axis and y-axis between the magnet unit 7 and the guide rail 2, and a pedestal 9.

Figure 3:
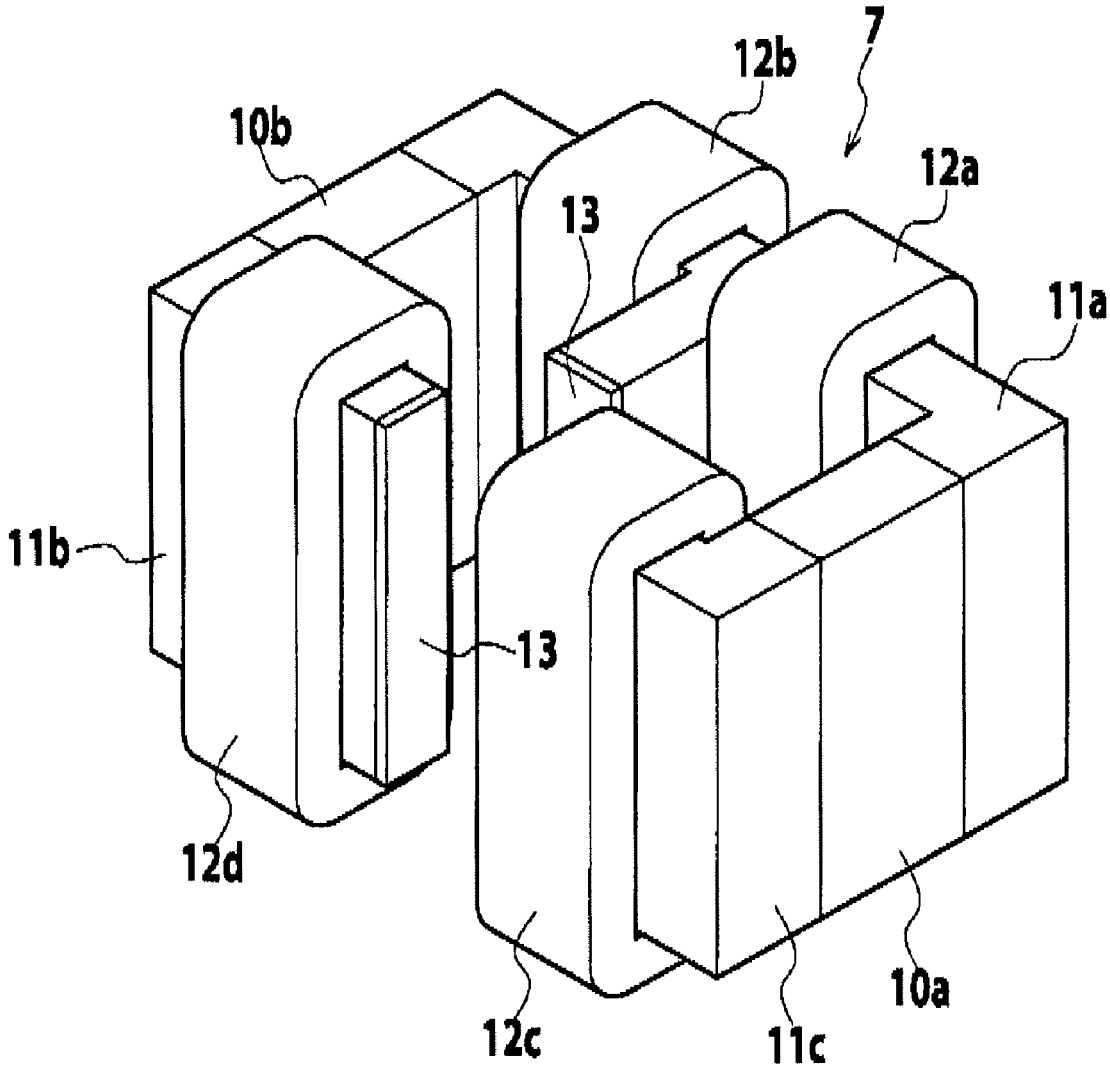
FIG. 3 is a perspective view showing a magnet unit in the guiding unit of the elevator of the first embodiment.

As shown in FIG. 3, the magnet unit 7 comprises a pair of permanent magnets 10*a*, 10*b* arranged on both sides of the guide rail 2, spliced irons 11*a*, 11*b*, 11*c* formed integrally with the permanent magnets 10*a*, 10*b* to be a substantial E-shaped assembly and provide magnetic poles opposed so as to surround both side faces of the guide rail 2 and its end face on three sides, coils 12*a*, 12*b*, 12*c*, 12*d* wound around the outer circumferences of the spliced irons 11*a*, 11*b*, 11*c* as cores to form an electromagnet that allows fluxes of the poles to be controlled, and solid lubricating members 13 formed on the poles' surfaces opposing to the guide rail 2.

Note that the solid lubricating members 13 are provided in order to allow the magnet unit 7 to support the guide rail 2 slidably even if the unit 7 comes in contact with the guide rail 2. For instance, the solid lubricating members 13 are manufactured by use of Teflon (trade mark), material containing graphite or molybdenum disulfide.

In this structure, by calculating currents for exciting the coils 12 based on state quantities in a magnetic circuit detected by the gap sensors 8 and other sensors, the elevator can be stably guided by levitation without making the guide rail 2 in contact with the magnet unit 7.

Figure 4:
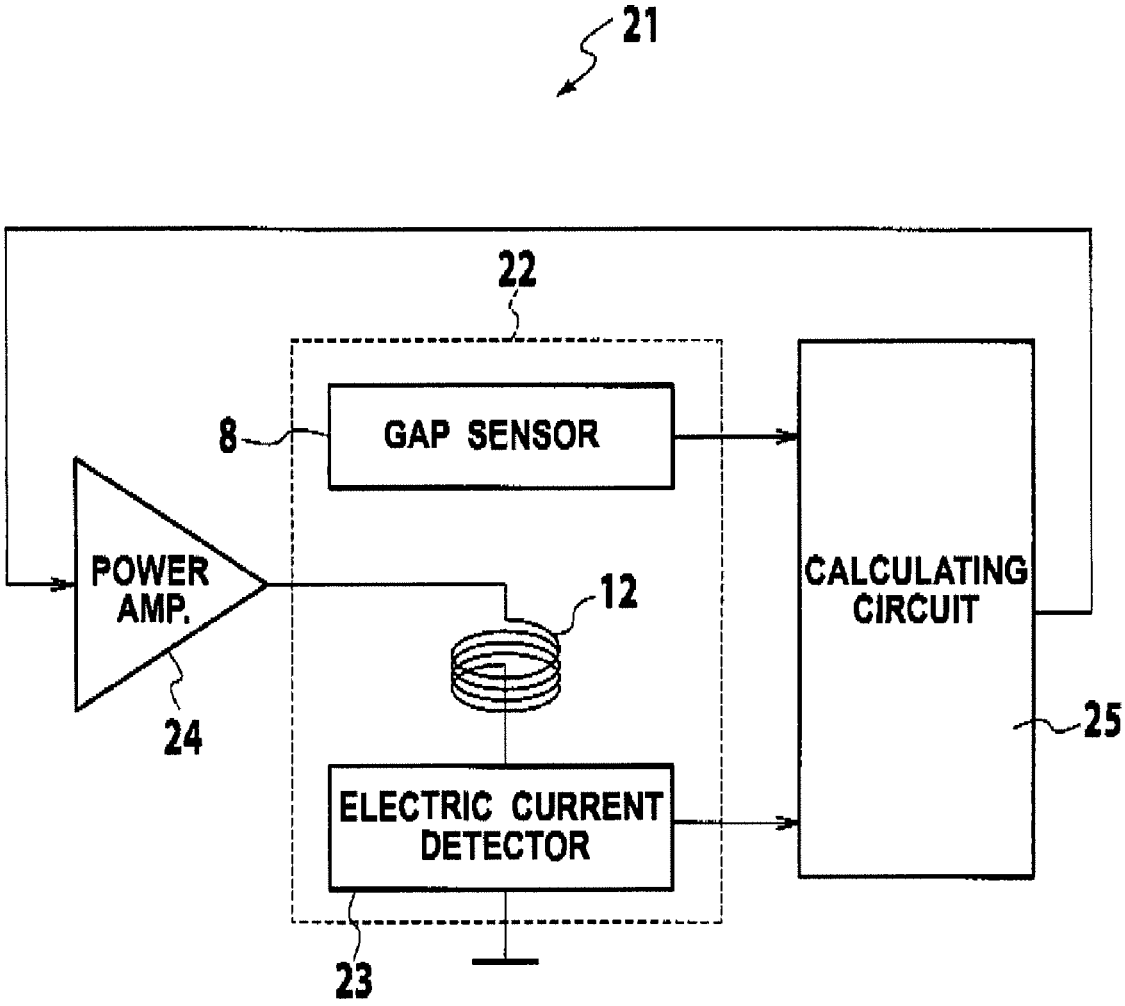
FIG. 4 is a block diagram showing a controller of the elevator of the first embodiment.

FIG. 4 is a schematic view of a controller for this non-contact guide. The controller 21 comprises a sensor part 22 for detecting physical values in the magnetic circuits formed by the magnet units 7 and the guide rails 2, a calculating circuit 25 for calculating voltages impressed to the coils 12 so as to guide the elevator car 3 in a non-contact state on the basis of signals of the sensor part 22 and a power amplifier 24 for supplying a power to the coils 12 based on an output of the calculating circuit 25, thereby controlling attractive forces of the guiding units 6.

The sensor part 22 is formed by the above gap sensors 8 for detecting each gap between the magnet unit 7 and the guide rail 2, and current detectors 23 for detecting current values flowing through the coils 12.

The calculating circuit 25 carries out a non-contact guide control by converging exciting currents of the coils 12 to zero in a steady state, performing a so-called "zero-power control" to hold the elevator car 3 stably due to the attraction force of the permanent magnets 10 irrespective of a weight of the elevator car 3 and a magnitude of disequilibrium force.

In the above way, since a magnetic guide system is formed by the zero-power control, the elevator car 3 is stably supported by the guide rails 2 in a non-contact manner. In the steady state, the current flowing in each coil 12 converges to zero, so that all the forces required to the stable supporting are purveyed by magnetic forces of the permanent magnets 10.

It is no difference in a situation that the weight of the elevator car 3 or its balance changes. If any disturbance is applied on the elevator car 3, a transitional current would flow in the coil 12 in order to make an air gap of a predetermined size. However, when the elevator is brought into the steady state again, the current flowing in the coils 12 converges to zero due to the adoption of the above-mentioned control technique, so that there is produced an air gap having a size to balance a load applied on the elevator car 3 and attraction forces generated by magnetic forces of the permanent magnets 10.

Note that the constitution of the magnet unit in the levitating guide and further details of the zero-power control are disclosed in Japanese Patent Application No. 2004-140763 and Japanese Patent Application Laid-open No, 2001-19286 (These publications are incorporated herein by reference).

Figure 5:
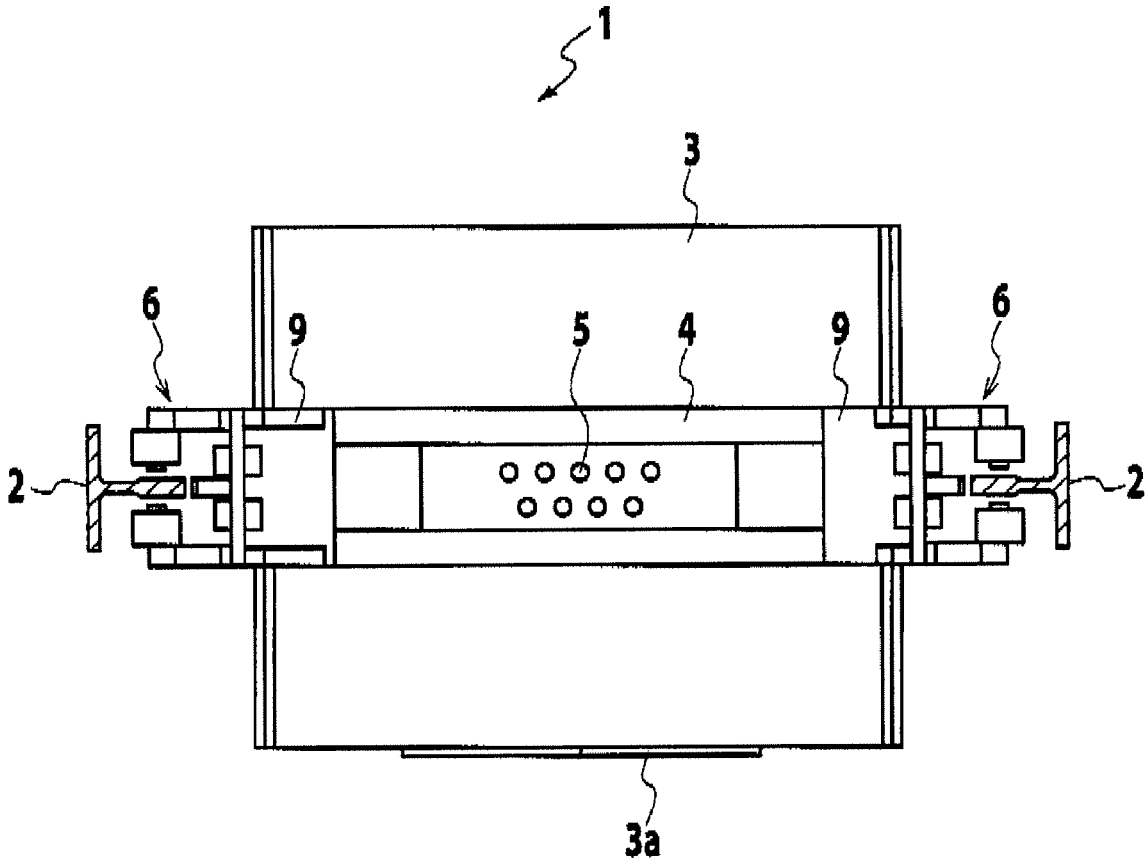
FIG. 5 is a top view showing a condition that the elevator of the first embodiment is elevating.
Figure 6:
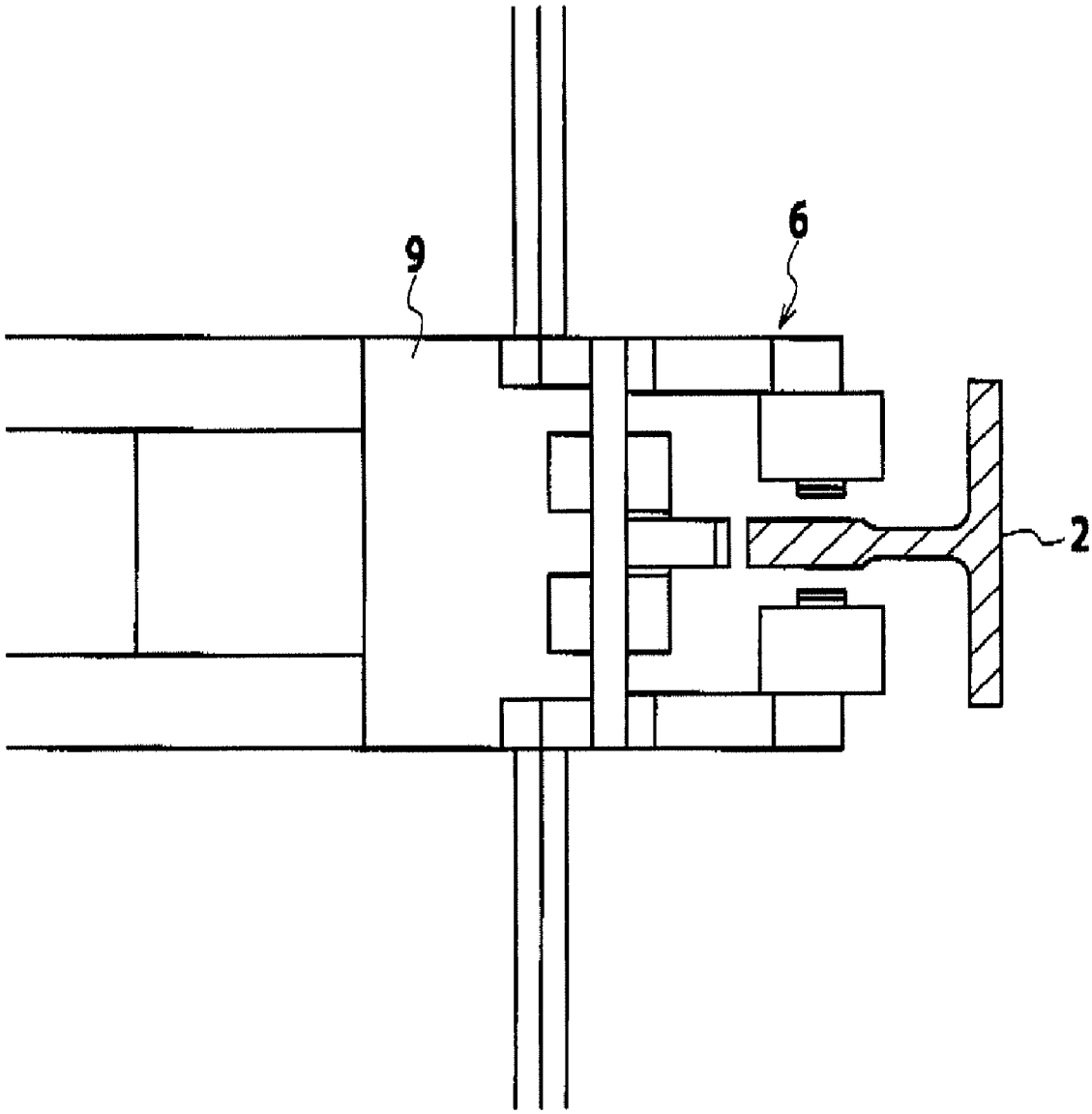
FIG. 6 is an enlarged view of the vicinity of the guiding unit of FIG. 5.

Normally, when the elevator car 3 is traveling, as shown in FIG. 5, there is ensured a gap between each guiding unit 6 and each guide rail 2 to guide the elevator car 3 without bringing them into contact with each other. The relationship between the guiding unit 6 and the guide rail 2 at that time is shown in FIG. 6 in enlargement.

Figure 7:
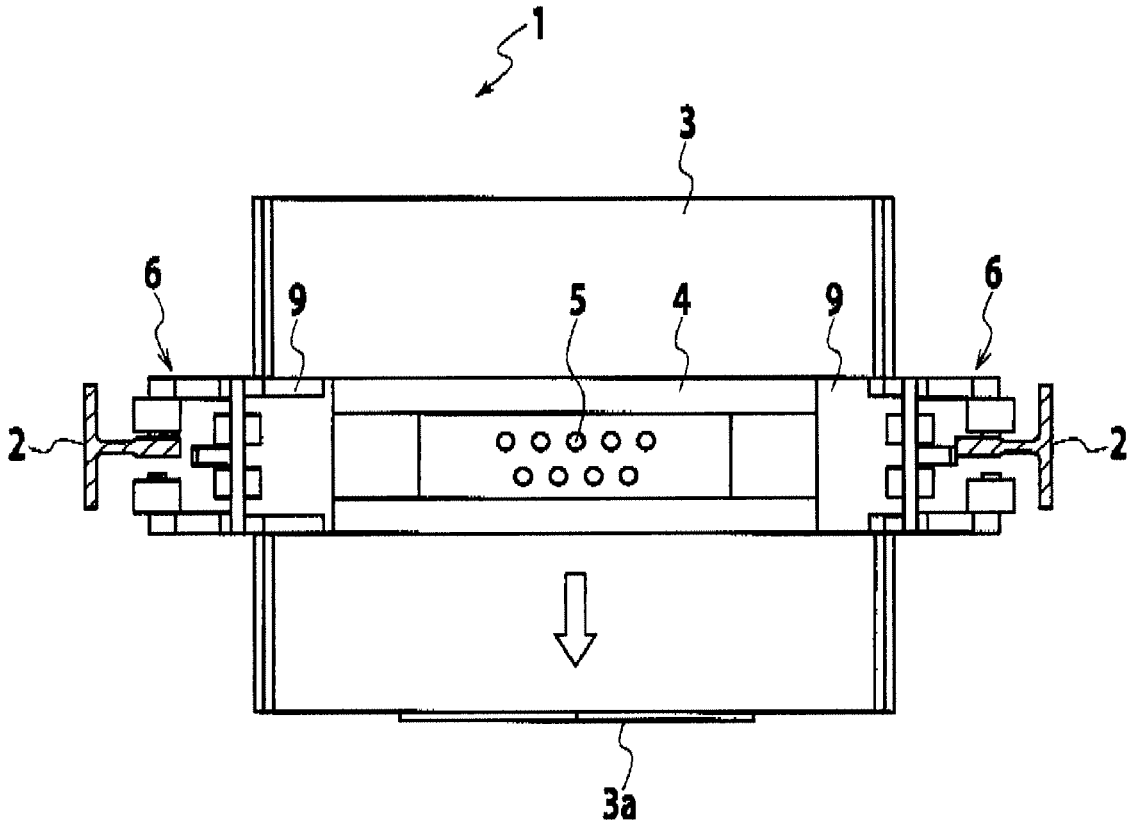
FIG. 7 is a top view showing a condition that the elevator of the first embodiment is stopped.
Figure 8:
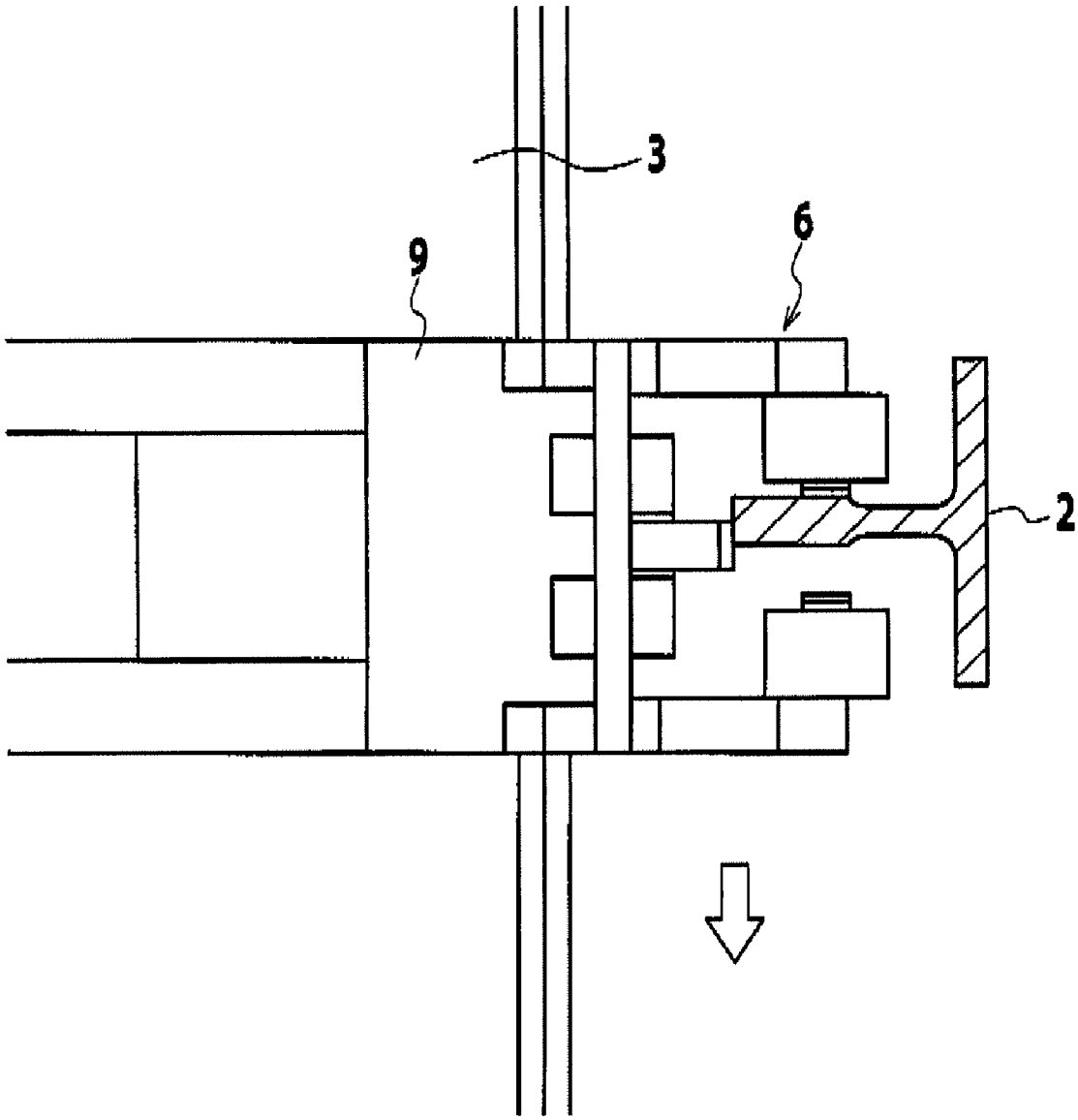
FIG. 8 is an enlarged view of the vicinity of the guiding unit of FIG. 7.

When the elevator car 3 stops at a predetermined position, the controller 21 regulates exciting currents for the coils 12 corresponding to this stopped state to change a relative position between the guiding unit 6 and the guide rail 2 gradually, displacing the elevator car 3 toward a door 3*a* for passengers (toward a hall) until parts of the guiding units 6 come into contact with the guide rails 2 finally, as shown in FIG. 7. The relationship between the guiding unit 6 and the guide rail 2 at that time is shown in FIG. 8 in enlargement. In this way, when the guiding units 6 come in contact with the guide rails 2 due to the attraction force of the permanent magnets 10, the exciting currents for the coils 12 in the guiding unit 6 are cut off.

Consequently, as the attraction force control by the electromagnets disappears, only magnetic force by the permanent magnets 10 of the magnet units 7 operates on the guiding units 6 and the guide rails 2. Thus, the guiding units 6 maintain a condition where the guiding units 6 are attracted to the guide rails 2 despite that the coils 13 are not excited by current, so that the elevator car 3 is supported in contact by the guide rails 2.

There is no need to perform the guide control while the elevator car 3 is stopped. Further, as the guiding units 6 are in contact with the guide rails 2, it is possible to support the elevator car 3 stably in spite of no excitation of the coils 12.

Generally, the elevator car 3 being supported with low rigidity for the purpose of transmitting disturbance at the cage's traveling, such as irregularities of the guide rails 2 and their joints, to the elevator car 3 with difficulty, has a comfortable ride. On the other hands, it is desirable to enhance the rigidity in order to cope with disturbance at stop, such as excessive load-variations caused by passenger's getting on and off the elevator and loading/unloading of shipments. In order to enhance the supporting rigidity while levitating the guiding units 6 on the guide rails 2 at stop, it is necessary to enhance the responsibility of the guide units 6. In such a case, conventionally, a large electric power is required in order to enhance the responsibility against the disturbance. Additionally, it becomes impossible to maintain the non-contact guiding state stably unless respective mechanical rigidities of both the guide rails 2 and the elevator car 3 are high at some level.

On the contrary, according to this embodiment, the disturbance from the guide rails 2 is remarkably reduced by guiding the traveling elevator car 3 by the guide rails 2 in non-contact manner. On the other hand, since the elevator car 3 at stop is supported strongly due to the contact of the guiding units 6 with the guide rails 2, it is possible to stably support the elevator car 3 in spite of excessive disturbance at the elevator's stop.

Further, since the magnet unit 7 has the permanent magnets 10 to produce the attraction force acting on the guide rails 2 in spite of no excitation of the coils 12, no electric power is required to maintain the attracted state. Additionally, there is neither deterioration in the stability of the control system nor resonance with a structural element.

Furthermore, by displacing the elevator car 3 toward the door 3*a* to make the elevator car 3 stopped, it is possible to narrow a gap between the elevator car 3 and a hatch hall, allowing a risk of dropping goods into the elevator shaft 1 to be reduced.

Additionally, in a situation where the elevator car 3 is stopped so that a part of the guiding unit 6 is in contact with the guide rail 2, if the elevator car 3 is subjected to a disturbance to depart the guiding units 6 from the guide rails 2, which is larger than attraction forces generated between the guiding units 6 and the guide rails 2 by the permanent magnets 10 of the guiding units 6, then the gap sensors 8 detect changes in the relative position of the guiding units 6 to the guide rails 2, so that the respective coils 12 are excited with current so as to increase the attraction forces between the guiding units 6 and the guide rails 2. Consequently, even when a larger load than the attraction forces by the permanent magnets 10 is applied on the elevator car 3, it becomes possible to support the elevator car 3 in condition that the guiding units 6 hardly departs from the guide rails 2.

Figure 9:
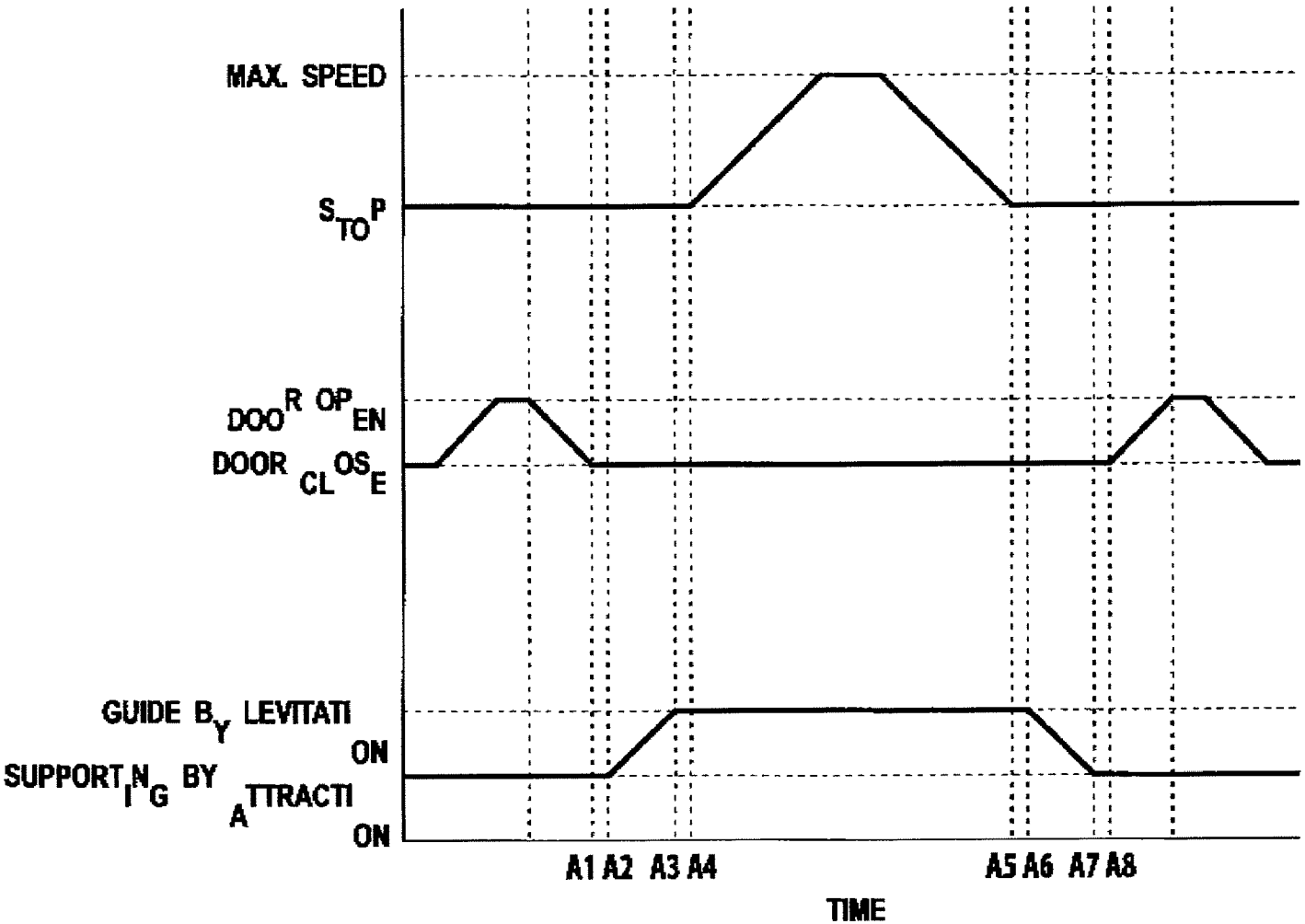
FIG. 9 is a graph showing the operation of the elevator of the first embodiment.

Next, the movement of the elevator car 3 and the operation of the guiding unit 6 will be described. FIG. 9 shows one example of respective movements of the elevator car 3, the door 3*a* and the guiding unit 6 in case of manipulating the guiding unit 6 in association with the traveling of the elevator car 3.

From above, the figure illustrates respective changes in terms of a traveling speed of the elevator car 3, opening/closing states of the door 3*a* and levitating/attracting states of the guiding unit 6. In a graph showing the state change of the guiding unit 6, "guide by levitation" means one situation where the guiding units 6 are separated from the guide rails 2 and brought into a non-contact guide condition stably, while "supporting by attraction" means another situation where a part of the guiding unit 6 comes into contact with the guide rail 2, so that the guiding unit 6 is attracted to the guide rail 2 due to the action of the permanent magnets 10.

In an initial state in FIG. 9, the elevator car 3 is stopped and the door 3*a* is closed. Then, as the elevator car 3 is stopping, the guiding unit 6 is attracted to the guide rail 2, so that the elevator car 3 is supported by the guide rails 2. Thus, it is possible to support the elevator car 3 with high rigidity against the disturbance of the opening/closing of the door 3*a* and the passengers' getting in and out the elevator.

At time A1, namely, when the door 3*a* is closed, the non-contact guide control of the guiding units 6 is stated. Between time A2 and time A3, it is performed to levitate the elevator car gradually. Then, at the time when the elevator car 3 is levitated stably, it is started to move the elevator car 3.

It is assumed here that A5 designates a point of time when the elevator car 3 has stopped as a result of reaching a destination floor. Subsequently, between time A6 and A7, it is performed to allow the guiding units 6 to attract the guide rails 2 gradually. Then, when the supporting state by attraction forces are accomplished since some parts of the guiding units 6 come into contact with the guide rails 2, the door 3*a* of the elevator car 3 is opened.

By performing the non-contact guide control in this procedure, it is possible to provide the elevator that the elevator car 3 is guided in non-contact with the guide rails 2 when the elevator car 3 is traveling, while the elevator car 3 is strongly supported in contact with the guide rails 2 when the passengers are getting in and out at an elevator's suspension.

Figure 10:
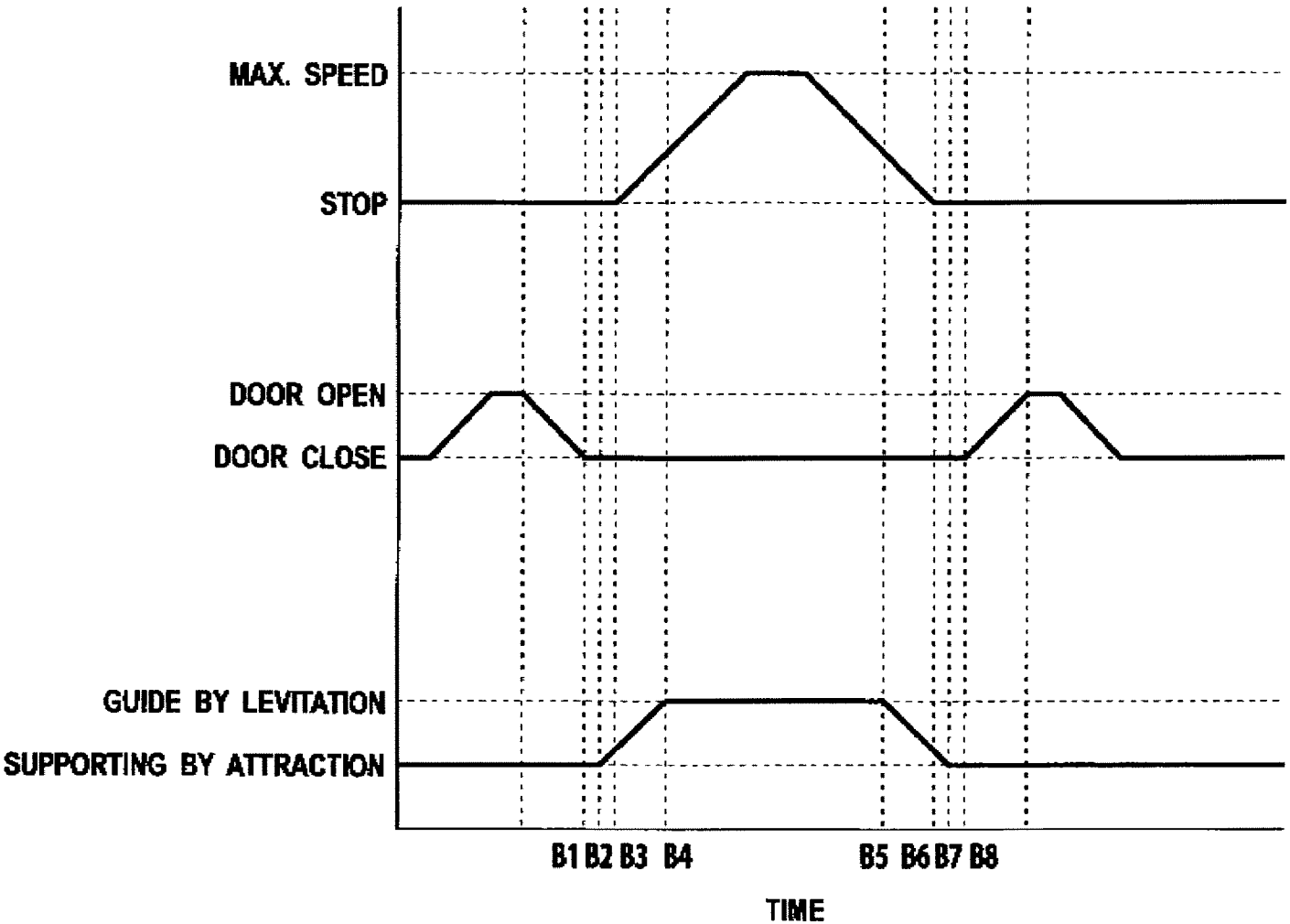
FIG. 10 is a graph showing the operation of an elevator of a second embodiment.

Next the operation of the elevator in accordance with the second embodiment will be described with reference to FIG. 10. Similarly to the first embodiment, it is assumed here that the elevator car 3 is stopped in the initial state of FIG. 10. Here, it is performed after closing the door 3*a* at time B1 to start the non-contact guide control where an air gap between the guiding units 6 and the guide rails 2 is gradually increased between time B2 and time B4, thereby levitating the elevator car 3. During this operation, the traveling of the elevator car 3 is started at the point of time B3 before the guiding unit 6 reaches a stable levitating position. Subsequently, the guiding unit 6 is moved to the stable levitating position during the elevator's traveling.

On the other hand, when the elevator car 3 begins to decelerate or comes close to a destination floor, it is started to approximate the guiding units 6 to the guide rails 2 while the elevator car 3 is still traveling. Then, after the elevator car 3 is stopped, it is performed to allow the guiding unit 6 to attract the guide rails 2 and thereafter, the door 3*a* is opened.

With the elevator car's traveling in this way, both time required in a process from the closing of the door 3*a* until the elevator car 3 begins to start and time required in another process from the stop of the elevator car 3 until the door 3*a* is opened are shortened to allow the passengers to get in and out the elevator car comfortably.

Figure 11:
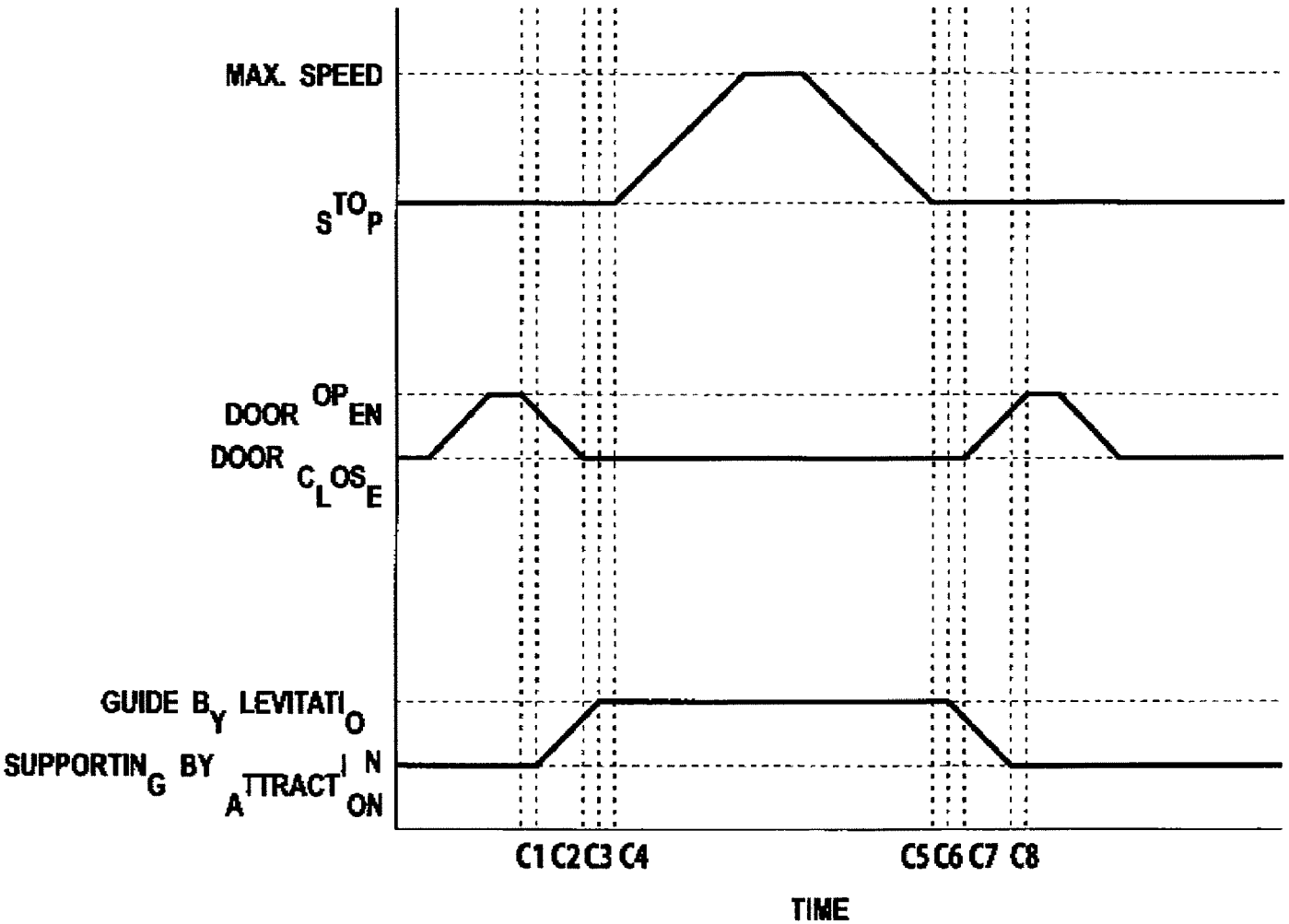
FIG. 11 is a graph showing the operation of an elevator of a third embodiment.

Next the operation of the elevator in accordance with the third embodiment will be described with reference to FIG. 11. In this embodiment, the levitating operation is started when the door 3*a* begins to close under the stop of the elevator car 3 (time C1). After closing the door 3*a* and before the elevator car 3 travels (time C3), the guiding units 6 are brought into its stable levitating state and thereafter, the elevator car 3 starts traveling. On the other hand, after arriving at a destination floor, it is performed upon the stop of the elevator car 3 to open the door 3*a* while allowing the guiding units 6 to attract the guide rail 2 gradually. With such an operation also, it is possible to shorten a time period between the closing/opening of the door 3*a* and the traveling of the elevator car 3.

Figure 12:
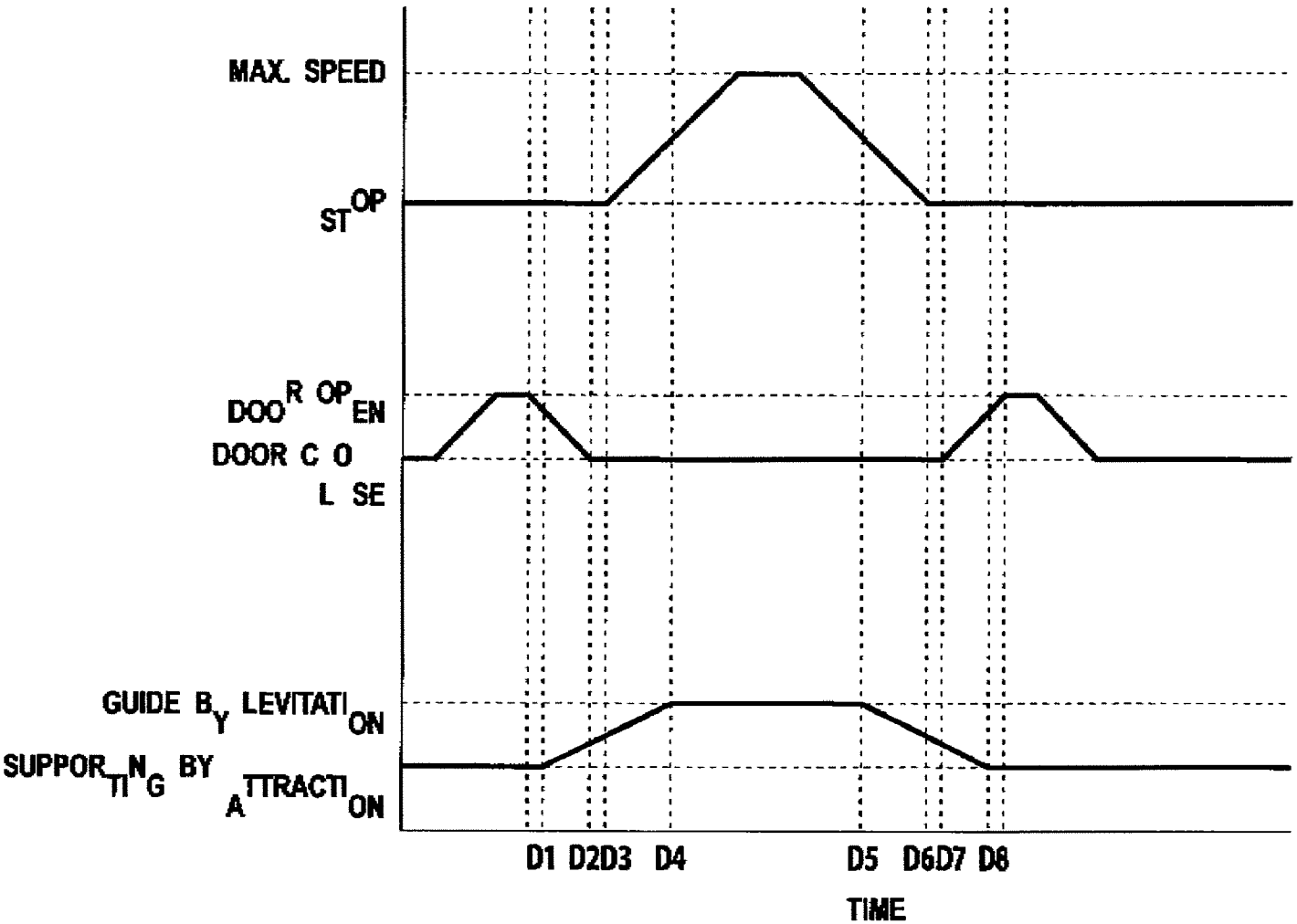
FIG. 12 is a graph showing the operation of an elevator of a fourth embodiment.

Next, the operation of the elevator in accordance with the fourth embodiment will be described with reference to FIG. 12. In this embodiment, the operation of the third embodiment in combination with the operation of the second embodiment is carried out. Thus, the levitating operation is started when the door 3*a* begins to close under the stop of the elevator car 3 and additionally, the traveling of the elevator car 3 is started at the point of time D3 without waiting for the stable levitating state. The guiding units 6 are brought into its stable levitating state at time D4 in the elevator car's traveling operation. On the other hand, when the elevator car 3 begins to decelerate or comes close to a destination floor, it is started to approximate the guiding unit 6 to the guide rail 2. Then, after the elevator car 3 is stopped, it is performed to allow the guiding unit 6 to attract the guide rails 2 until the door 3*a* is completely opened. Then, in addition to a shortage in the time period between the closing/opening of the door 3*a* and the traveling of the elevator car 3, it is possible to reduce an influence on the ride quality that the passengers feel when the elevator is in the attracting/levitating operation because the position of the guiding unit 6 varies slowly while taking respective periods from time D1 to time D4 and from time D5 to time D8.

Although we have illustrated here the guide procedure by citing four embodiments, it is allowed to put these embodiments in combination into practice.

In common with the above-mentioned embodiments, we have explained the structure where the magnet unit contains the permanent magnet whose attraction force attracts and fixes the guide rail when the guiding unit comes into contact with the guide rail. In the modification, however, the magnet unit may be formed by only an electromagnet whose attraction force attracts and fixes the guide rail.

Besides this, various modifications may be applied to the above-mentioned embodiments without departing from the contents of the present invention.

INDUSTRIAL APPLICABILITY

According to the elevator of the present invention, as it is constructed so that when the elevator car is stopped, passengers can get on and off the elevator under condition that the passenger cage is fixed on the guide rail, there is no possibility that the elevator car swings and the guiding unit collides with the guide rail.

The invention claimed is:

1. An elevator comprising:

a guide rail provided in an elevator shaft vertically;

an elevator car moving up and down along the guide rail;

a guiding unit provided on the elevator car for guiding the elevator car, the guiding unit having a magnet unit containing a core and coils forming an electromagnet thereby generating a magnetic force against the guide rail through an air gap; and a controller for controlling the magnetic force by maneuvering an exciting current for exciting the electromagnet, wherein the controller is configured to control the magnetic force so as to:

displace the elevator car gradually so as to produce an air gap between the guiding unit and the guide rail when the elevator car starts to move;

bring the guiding unit into non-contact with the guide rail when the elevator car is traveling; and reduce an air gap between the guiding unit and the guide rail partially to displace the elevator car gradually and bring the guiding unit into contact with the guide rail when the elevator car is stopped, whereby the guiding unit attracts and fixes the guide rail while the elevator car is stopped.

2. The elevator of claim 1, wherein the controller displaces the elevator car toward a hall of a floor for stop when the elevator car is stopped, thereby bringing the guiding unit into contact with the guide rail.

3. The elevator of claim 1, wherein the magnet unit includes a permanent magnet, and the controller is further configured to shut off the exciting current for the electromagnet under condition that the guiding unit attracts the guide rail.

4. The elevator of claim 1, wherein the controller is further configured to control the exciting current for the electromagnet so as to increase an attraction force on a contact portion between the guiding unit and the guide rail when the guiding unit operates to depart from the guide rail under condition that the elevator car is stopped and the guiding unit comes into contact with the guide rails.

5. An elevator comprising:

a guide rail provided in an elevator shaft vertically;

an elevator car moving up and down along the guide rail;

a guiding unit provided on the elevator car for guiding the elevator car, the guiding unit having a magnet unit containing a core and coils forming an electromagnet thereby generating a magnetic force against the guide rail through an air gap; and a controller for controlling the magnetic force by maneuvering an exciting current for exciting the electromagnet, wherein the controller is configured to control the magnetic force so as to:

bring the guiding unit into non-contact with the guide rail when the elevator car is traveling;

reduce an air gap between the guiding unit and the guide rail to displace the elevator car gradually when the elevator car is approaching its stop position; and bring the guiding unit into contact with the guide rail after the elevator car is stopped, whereby the guiding unit attracts and fixes the guide rail while the elevator car is stopped.

6. The elevator of claim 5, wherein the controller displaces the elevator car toward a hall of a floor for stop when the elevator car is stopped, thereby bringing the guiding unit into contact with the guide rail.

7. The elevator of claim 5, wherein the magnet unit includes a permanent magnet, and the controller is further configured to shut off the exciting current for the electromagnet under condition that the guiding unit attracts the guide rail.

8. The elevator of claim 5, wherein the controller is further configured to control the exciting current for the electromagnet so as to increase an attraction force on a contact portion between the guiding unit and the guide rail when the guiding unit operates to depart from the guide rail under condition that the elevator car is stopped and the guiding unit comes into contact with the guide rails.

9. An elevator comprising:

a guide rail provided in an elevator shaft vertically;

an elevator car moving up and down along the guide rail;

a guiding unit provided on the elevator car for guiding the elevator car, the guiding unit having a magnet unit containing a core and coils forming an electromagnet thereby generating a magnetic force against the guide rail through an air gap; and a controller for controlling the magnetic force by maneuvering an exciting current for exciting the electromagnet, wherein the controller is configured to control the magnetic force so as to;

bring the guiding unit into non-contact with the guide rail when the elevator car is traveling;

bring the guiding unit into contact with the guide rail when the elevator car is stopped, whereby the guiding unit attracts and fixes the guide rail while the elevator car is stopped; and displace the elevator car gradually so as to increase or decrease the air gap between the guiding unit and the guide rail when a door of the elevator car opens and closes, thereby bringing the guiding unit into contact with the guide rail or separating the guiding unit from the guide rail.

10. The elevator of claim 9, wherein the controller displaces the elevator car toward a hall of a floor for stop when the elevator car is stopped, thereby bringing the guiding unit into contact with the guide rail.

11. The elevator of claim 9, wherein the magnet unit includes a permanent magnet, and the controller is further configured to shut off the exciting current for the electromagnet under condition that the guiding unit attracts the guide rail.

12. The elevator of claim 9, wherein the controller is further configured to control the exciting current for the electromagnet so as to increase an attraction force on a contact portion between the guiding unit and the guide rail when the guiding unit operates to depart from the guide rail under condition that the elevator car is stopped and the guiding unit comes into contact with the guide rails.

* * * * *